US008878104B2

(12) United States Patent
Shaffer et al.

(10) Patent No.: US 8,878,104 B2
(45) Date of Patent: Nov. 4, 2014

(54) VOLTAGE SWITCHING MICROSWITCH FOR HOT SURFACE IGNITER SYSTEM

(75) Inventors: Timothy Scott Shaffer, La Grange, KY (US); Daniel Vincent Brosnan, Louisville, KY (US)

(73) Assignee: General Electric Company, Schenectady, NY (US)

( * ) Notice: Subject to any disclaimer, the term of this patent is extended or adjusted under 35 U.S.C. 154(b) by 958 days.

(21) Appl. No.: 12/951,314

(22) Filed: Nov. 22, 2010

(65) Prior Publication Data

US 2012/0125910 A1 May 24, 2012

(51) Int. Cl.
*F23Q 7/10* (2006.01)
*H01H 19/62* (2006.01)

(52) U.S. Cl.
CPC ..... *H01H 19/62* (2013.01)
USPC ..... 219/262; 219/260; 126/39 E; 126/39 G; 126/39 H; 126/39 N; 126/39 R; 200/6 B; 200/19.2; 200/336

(58) Field of Classification Search
USPC ..... 219/260, 262; 126/39 E, 39 G, 39 H, 126/39 N, 39 R; 431/254, 255, 256, 258; 200/6 B, 19.2, 336, 564, 568, 573, 574
See application file for complete search history.

(56) References Cited

U.S. PATENT DOCUMENTS

| | | | | |
|---|---|---|---|---|
| 3,299,225 | A * | 1/1967 | Willans | 200/6 B |
| 3,866,317 | A * | 2/1975 | Morrill, Jr. | 29/622 |
| 4,099,906 | A | 7/1978 | Pinckaers | |
| 4,121,184 | A * | 10/1978 | Dinkler et al. | 335/179 |
| 5,951,276 | A | 9/1999 | Jaeschke et al. | |
| 6,322,352 | B1 * | 11/2001 | Zink | 431/27 |
| 6,777,653 | B2 | 8/2004 | Burkhart | |
| 7,148,454 | B2 | 12/2006 | Chodacki et al. | |
| 7,175,390 | B2 * | 2/2007 | Wobben | 416/61 |
| 2002/0073985 | A1 * | 6/2002 | Leukhardt et al. | 126/39 E |
| 2004/0250808 | A1 * | 12/2004 | Haynes et al. | 126/39 E |
| 2006/0068348 | A1 * | 3/2006 | Blank et al. | 431/78 |
| 2008/0003532 | A1 * | 1/2008 | Gjerde et al. | 431/256 |
| 2012/0199113 | A1 * | 8/2012 | Barrena et al. | 126/39 BA |

* cited by examiner

*Primary Examiner* — Dana Ross
*Assistant Examiner* — James Sims, III
(74) *Attorney, Agent, or Firm* — Dority & Manning, P.A.

(57) ABSTRACT

A voltage switching microswitch is provided for supplying power to a hot surface igniter in a gas burning system. The microswitch is configured to operate concurrently with manual operation of a gas control valve such that rotation of an operating stem of the gas control valve produces rotation of a cam within the microswitch. The cam is configured to operate a pair of reed switches so that a relatively high voltage from a power supply is applied to the hot surface igniter following a first predetermined amount of rotation of the cam and a relatively lower voltage is applied to the hot surface igniter following a second predetermined amount of rotation of the cam to maintain the temperature of the igniter.

20 Claims, 2 Drawing Sheets

VOLTAGE SWITCHING MICROSWITCH FOR HOT SURFACE IGNITER SYSTEM

FIELD OF THE INVENTION

The present subject matter relates generally to a method and apparatus for igniting a burner flame, and, more particularly, to a switch configuration for applying operating voltages to a hot surface igniter.

BACKGROUND OF THE INVENTION

Some gas-fired cooktops include an ignition device to generate a spark to ignite a burner when applicable fuel valves are opened to deliver fuel to the burner. Other gas-fired cooktops utilize a ceramic hot surface igniter to ignite the burner. Rather than relying on a spark, a ceramic hot surface igniter includes an element that generates sufficient heat to ignite the gas supplied to the burner.

U.S. Pat. No. 7,148,454 to Chodacki et al. discloses a system for regulating voltage to an electrical resistance igniter. That system determines the line voltage supplied to the system and controls the voltage being applied to the electrical resistance igniters so a first voltage is applied initially and for a time period and thereafter a second voltage is applied, the second voltage being the operating voltage for the igniter.

U.S. Pat. No. 6,777,653 to Burkhart describes a controller for controlling an igniter, such as a silicon nitride hot surface igniter, by providing high frequency switching of full wave rectified alternating current across the igniter using a switching transistor in combination with a filter and a full wave rectifier bridge. The igniter controller may be tuned based upon the particular igniter in connection with which control is provided to allow for precise control of switching of power to the igniter. The full wave rectifier bridge is provided in connection with the switching transistor to provide high frequency switching of AC power across the igniter.

U.S. Pat. No. 5,951,276 to Jaeschke et al. describes an electrically enhanced hot surface igniter wherein an electronic control circuit is provided for a gas oven that includes a hot surface igniter that is heated through the application of electrical current to a temperature sufficient to ignite gas supplied through an electrically actuatable gas valve. The applied current is regulated by a micro-controller that controllably gates on a triac while taking into consideration a sensed current level.

U.S. Pat. No. 4,099,906 to Pinckaers describes a hot surface fuel ignition system including a special regulating type of transformer used to energize a hot surface igniter, a fuel valve and a fuse in a series circuit. The design of the regulating transformer provides an operating current in the igniter and valve that will not blow the fuse as long as the igniter is neither short-circuited nor heated to a level which would be destructive.

Each of these known systems provides a fairly complex electrical system for applying and controlling various voltage levels to hot surface igniters. Some of the systems also provide electronic coordination and control of the gas flow to automatically control the entire ignition process. Such systems may be considered to be overly complex and expensive to provide.

In view of these known concerns it would be advantageous to provide a simple switching system that can be manually operated concurrently with the operation of a gas valve to effectively provide ignition of the gas for appliances such as a cooktop.

BRIEF DESCRIPTION OF THE INVENTION

Aspects and advantages of the invention will be set forth in part in the following description, or may be obvious from the description, or may be learned through practice of the invention.

The present subject matter relates to apparatus and methodologies for providing dual level voltages to a hot surface igniter by way of a microswitch associated with a gas flow-controlling valve.

In certain embodiment, the present subject matter relates to a cooktop comprising a gas burner with a hot surface igniter positioned proximate the gas burner. The cooktop has associated with it a gas flow controlling valve having a manually operable gas flow controlling stem on which is mounted a microswitch configured for concurrent operation with said gas flow controlling stem.

In certain embodiments, a microswitch is provided comprising a first pair of reed elements and a second pair of reed elements positioned generally perpendicularly to the first pair of reed elements. The microswitch includes a generally circular rotatable cam having a central pivoting point and plural outer perimeter portions. The outer perimeter portions are diversely spaced from the central pivoting point. The reed elements are configured such that one of the reed elements from each of the first and second pair of reed elements are electrically coupled together to form a common connection. A cam is configured so that rotation thereof causes the other of the reed elements from the first pair of reed elements to be electrically coupled to the commonly connected reed elements for a portion of the rotation of the cam and further rotation of the cam causes the other of the reed elements from the second pair of reed elements to be electrically coupled to the common connected reed elements for a further portion of the rotation of the cam.

In certain embodiments, the microswitch includes a housing configured to contain the first and second pairs of reed elements and the cam and includes a connection point coupled to the commonly connected reed elements extending outside the housing along with a portion of each of the first and second pair of reed elements.

In selected embodiments, the cam is provided with a keyed opening, which may be a D-shaped opening, encompassing the central pivoting point. In particular embodiments, the plural outer perimeter portions of the cam are configured such that rotation of the cam from an initial position for a first predetermined number of degrees of rotation produces no contact between either of the first or second pair of reed elements. Further rotation of the cam beyond the first predetermined number of degrees produces contact between the first pair of reed elements for a second predetermined number of degrees of rotation and rotation following the second predetermined number of degrees of rotations produces contact between the second pair of reed elements and discontinues contact between the first pair of reed elements. In particular embodiments, the first predetermined number of degrees is about thirty degrees and the second predetermined number of degrees of rotation is about forty degrees.

The present subject matter also relates to an ignition system that includes a housing and first and second pairs of reed elements positioned at least partially within the housing and forming first and second switches. A rotatable cam is positioned within the housing and is configured to sequentially close the first and second switches. A hot surface igniter is provided along with a power supply configured to provide first and second voltage levels. The microswitch is configured so that rotation of the cam causes voltage at the first voltage level to be applied to the hot surface igniter and so that further rotation of the cam causes voltage as the second voltage level to be applied to the hot surface igniter.

In selected embodiments, the cam is provided with a keyed opening, that may be D-shaped, that is configured to cooperate with a gas valve for simultaneous operation. In other selected embodiments, one of the reeds from each of the first and second pair of reed elements are electrically coupled together and the first voltage level is applied to the other reed of the first pair of reed elements and the second voltage level is applied to the other reed of said second pair of reed elements such that both switches are never closed simultaneously.

In particular embodiments, the cam is configured such that it must be rotated a first predetermined number of degrees from an initial position before the first switch is closed rotated a second predetermined number of degrees before the second switch is closed. Rotation of the cam beyond the second predetermined number of degrees causes the first switch to open.

The present subject matter also relates to a method of igniting gas concurrently with manual operation of a gas controlling valve comprising providing a hot surface igniter, a power supply configured to provide first and second voltage levels, and a microswitch configured to sequentially supply the first and second voltage levels to the hot surface igniter. In particular embodiments, the method provides for supplying the microswitch with a rotatable cam wherein the cam is configured for concurrent rotation with a stem of a gas-controlling valve.

In selected embodiments, the method provides for providing first and second voltage levels sufficient to heat a hot surface igniter to a level sufficient to ignite gas proximate the hot surface igniter and a second voltage level sufficient to maintain the hot surface igniter at an elevated temperature. In other selected embodiments, the method provides for supplying power from a power supply including a transformer having a single primary winding and first and second secondary windings and including full wave rectifiers couple to each of the secondary windings.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
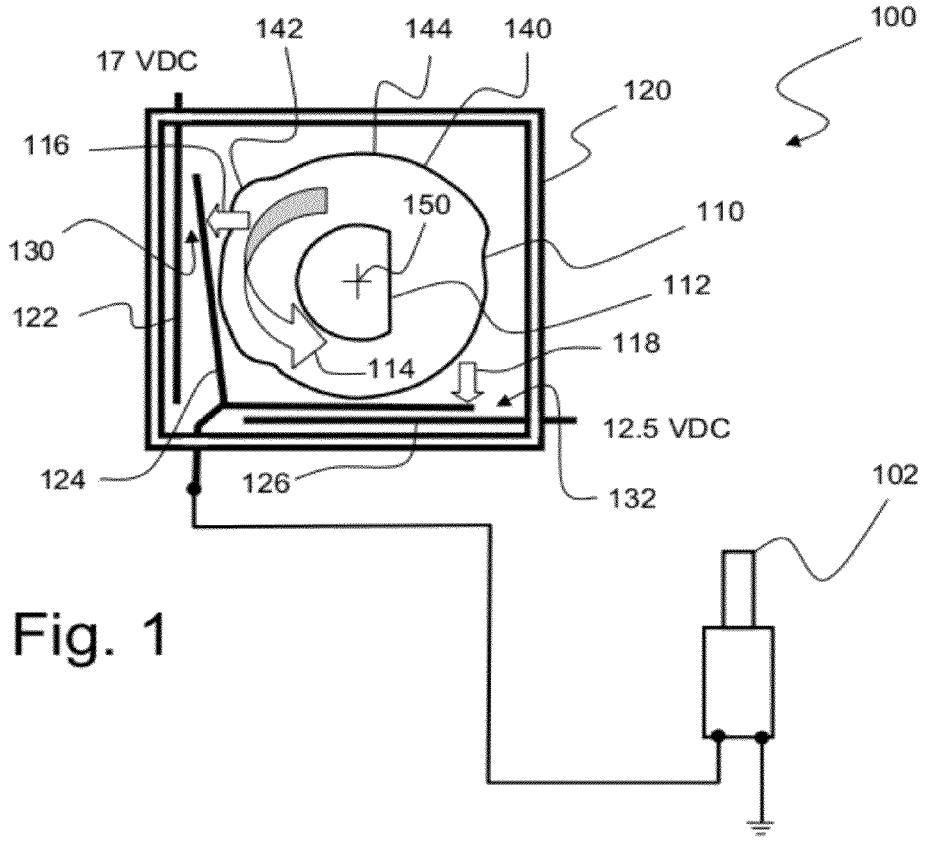
FIG. 1 is an illustration of a dual cam microswitch and associated hot surface igniter circuit that may be associated with a gas valve in accordance with present technology.

Repeat use of reference characters throughout the present specification and appended drawings is intended to represent same or analogous features or elements of the invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As noted in the Summary section, the present subject matter is directed toward a microswitch that may be associated with a gas flow controlling valve in, for example, a cooktop. Devices similar to cooktops may use spark ignition systems but more often now, because of electrical interference caused by spark generating devices, use hot surface igniters to ignite gas burners.

In accordance with present technology, to facilitate rapid ignition, a high voltage is applied at a specified ignition point. To maintain the igniter at ignition temperatures, a second, lower voltage is applied at all other operating points. Power is supplied with a dual circuit transformer and a rectifying circuit that supplies both the ignition voltage and the lower temperature maintaining voltage from the same supply. Per present technology a much-simplified dual throw microswitch configuration is provided to achieve application of the different voltage levels at the proper operating points.

Figure 3:
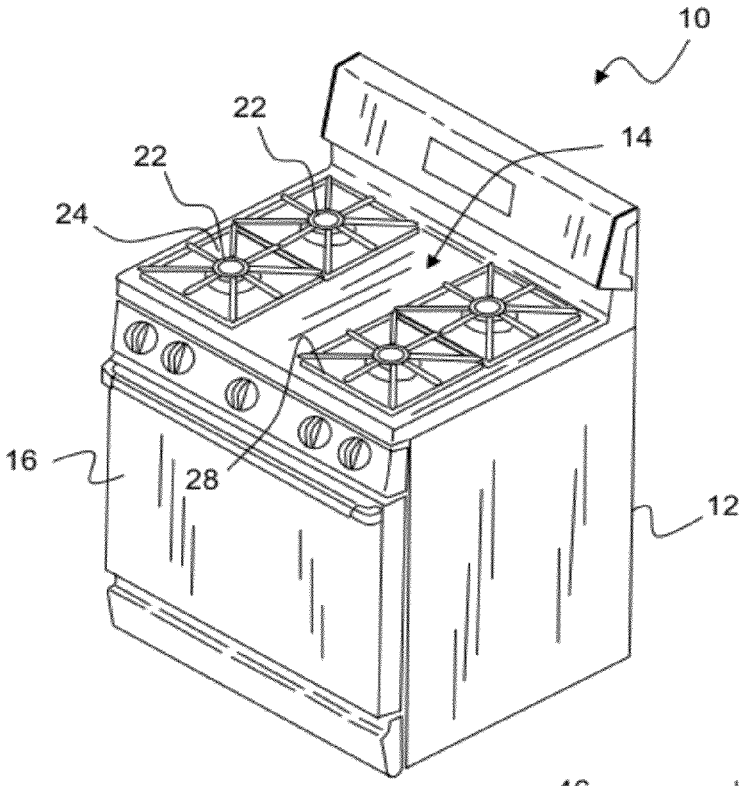
FIG. 3 illustrates an exemplary gas range with which the present subject matter may be employed.
Figure 4:
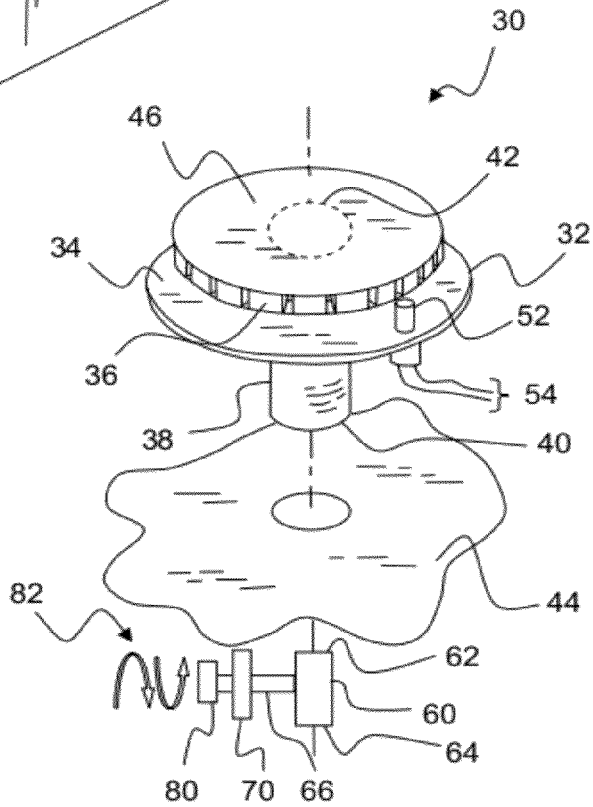
FIG. 4 is an exploded view of an exemplary burner assembly including a hot surface igniter with which the present subject matter may be used.

First with reference to FIGS. 3 and 4 there are illustrated exemplary gas range and burner assemblies with which the present subject matter may be employed. FIG. 3 illustrates an exemplary freestanding gas range 10 in which the herein described methods and apparatuses may be practiced. Range 10 includes an outer body or cabinet 12 that incorporates a generally rectangular cooktop 14. An oven (not separately illustrated) is positioned below cooktop 14 and has a front-opening access door 16.

Cooktop 14 includes a plurality of gas fueled burner assemblies 22 which are positioned in spaced apart positions on cooktop 14. It will be appreciated that while the present exemplary range illustrates four burners 22 positioned on cooktop 14, more or less burners may be provided up to, for example, six. A recessed area 24 of cooktop 14 surrounds each burner assembly 22. Each burner assembly 22 extends upwardly through an opening in recessed areas 24, and a grate 28 is positioned over each burner 22. Each grate 28 includes a flat surface thereon for supporting cooking vessels and utensils over burner assemblies 22 for cooking of meal preparations placed therein.

The construction and operation of the range heating elements, including cooktop gas burner assemblies 22 are believed to be within the purview of those in the art without further discussion, and as details of the range heating elements are generally beyond the scope of the herein described methods and apparatuses, further description thereof is omitted. Further, it is contemplated that the herein described methods and apparatuses may find utility in combination with other heat sources besides range gas burners 22.

FIG. 4 is an exploded perspective view of an exemplary burner assembly 30 and igniter controlling microswitch 70 that can be used with gas range 10. Burner assembly 30 includes a burner body 32, a base portion 34, and a sidewall 36 extending axially from the periphery of base portion 34. A main gas conduit 38 having an entry area 40 and a burner throat region 42 illustrated in phantom under cap 46 is open to the exterior of burner body 32 and defines a passage which extends axially through the center of burner body 32 to provide fuel/air flow to burner assembly 30. Gas flow controlling valve 60 is provided with an inlet 64 that may be coupled to a source of gas and an outlet 62 that may be coupled via a separately un-illustrated gas conduit to entry area 40 of main gas conduit 38. As used herein, the term "gas" refers to a combustible gas or gaseous fuel-air mixture.

Burner assembly 30 is mounted on a support surface 44, such as cooktop 14, of a gas-cooking appliance such as a range or a cooktop. Cap 46 is disposed over the top of burner body 32, defining there between an annular main fuel chamber. Burner assembly 30 also includes at least one igniter 52 extending through an opening in base portion 34. In the exemplary embodiment, igniter 52 is a hot surface igniter that may be fabricated from a ceramic material and includes connecting wires 54 that couple igniter 52 to a hot surface igniter circuit.

In accordance with present technology, gas controlling valve 60 is provided with a gas flow controlling stem 66 on which may be mounted microswitch 70 constructed in accordance with present technology for concurrent operation with gas flow controlling stem 66. As gas flow controlling stem 66 is rotated as represented by arrows 82 by a consumer using, for example, knob 80, electrical contact within microswitch 70 will operate internal electrical switches to couple power to hot surface igniter 52 by way of connecting wires 54 as will be explained below.

With reference to FIG. 1, there is illustrated a dual cam microswitch 100 and associated hot surface igniter circuit that may be associated with a gas valve in accordance with present technology. As is well known to those of ordinary skill in the art, hot surface igniters (HSI) such as exemplary HSI 102 may be positioned on cooktops proximal to a gas burner such that gas released by operation of a gas flow control valve may be ignited. Depending on the specific application, a plurality of such burners and HSI devices may be provided. For example, cooktops for residential use may provide from four to six burners, each with its own HSI.

It should be appreciated that, while the present disclosure is directed to HSI devices as related to use in a cooktop environment, such is not intended to be a limitation of the subject matter. For example, the described device may be used in other gas ignition environments, such as, without limitation, for ignition of other heating devices such as outdoor type heaters like patio heaters or for indoor gas log fireplaces.

In accordance with present technology, a microswitch 100, similar in some aspects to the switches used with previously employed spark igniter system is provided, but in this instance is associated with a gas flow-controlling valve for simultaneous manual operation therewith. In lieu of modulating an on-off relay to a spark module, microswitch 100, as described herein, may be configured to either close contacts to a higher voltage circuit or, alternatively, close contacts to a lower voltage circuit as dual cam 110 rotates upon manual operation of a gas flow control valve.

More specifically, microswitch 100 generally corresponds to a housing 120 enclosing and supporting a number of metallic reeds 122, 124, 126. Dual cam 110 may be constructed of an insulative material and, as generally illustrated in FIG. 1, includes a generally circular rotatable disk shaped portion having an outer perimeter edge or surface 140 that provides a number of perimeter portions at different radial distances from a central pivoting point 150. Dual cam 110 is also provided with a keyed, generally D-shaped, central opening 112 therein that is designed to fit over the operating stem of a gas flow control valve (not separately illustrated).

In operation, a consumer will operate a knob associated with the valve stem of a gas flow control valve with which microswitch 100 is associated to both initiate gas flow and begin an ignition process. Microswitch 100 and dual cam 110 are rotated in the direction of arrow 114 through about 70 degrees of rotation together with the stem of an associated gas flow control valve.

As the stem of the gas flow control valve is manually rotated by a consumer, dual cam 110 will exert force in the direction of arrows 116, 118 on a pair of electrical switches formed by metallic reeds 122, 124 and 124, 126 where contact gaps 130, 132, respectively are formed. It will be appreciated that, as illustrated in FIG. 1, metallic reeds 122, 124 and 124, 126 form a first and second pair of contact switches that are generally perpendicularly spaced from one another.

In alternative configurations, closure of the contacts across gaps 130, 132 may produce closure of a relay (not separately illustrated) to the higher voltage circuit or would close the relay to a lower voltage circuit. Of course closure of the contacts points between reeds 122, 124, and 124, 126 may be used to directly energize HSI 102 without the use of a relay if the reeds are designed to carry the appropriate current load.

In an exemplary configuration, as a consumer rotates the gas control knob and dual cam 110 coupled therewith, for the first 30 degrees or rotation, both the relatively higher and lower voltage circuits will remain open. As cam 110 continues to rotate in the direction of arrow 114, relatively higher surface area 142 of cam 110 will push reed 124 in the direction of arrow 116 to force reed 124 into contact with reed 122 thereby completing a circuit at gap 130. Contact through the circuit created at gap 130 will connect the relatively higher voltage, represented here as 17 VDC to HSI 102. Typically this contact between reeds 122 and 124 will be maintained between 30 to 70 degrees of rotation of cam 110.

From about 70 degrees of rotation and higher, the relatively higher surface area 142 of cam 110 will push reed 124 in the direction of arrow 118 to force reed 124 into contact with reed 126 thereby completing a circuit at gap 132. Closure of the contacts at gap 132 causes application of a relatively lower voltage at, for example, 12.5 VDC to HSI 102 to assist in maintaining heating of HSI 102. At the same time, the relatively lower portion 144 of cam 110 will be in contact with reed 124 and, although it will exert a force on reed 124 in the direction of arrow 116, this portion 144 of cam 110 is of insufficient height to close the contacts at gap 130 and thus the relatively higher voltage will be disconnected from HSI 102.

It should be appreciated that while microswitch 100 as presently illustrated uses a dual cam 110 to close either the high voltage or the low voltage, to minimize overall height of the microswitch, the cams are placed at different radial distances from the center of the pivoting point, which is locked rotationally to the gas valve stem and to the motion of the gas control knob. A common neutral set of metallic reeds 124 are used to connect either to the low voltage or to the high voltage supply. As illustrated in FIG. 1, the cam pushes against the cantilevered neutral reed 124 until it contacts the stationary metallic leads 122, 126 going off to either the high or low voltages, respectively. It would be just as acceptable, however, to reverse to moving and stationary members to the same effect.

Figure 2:
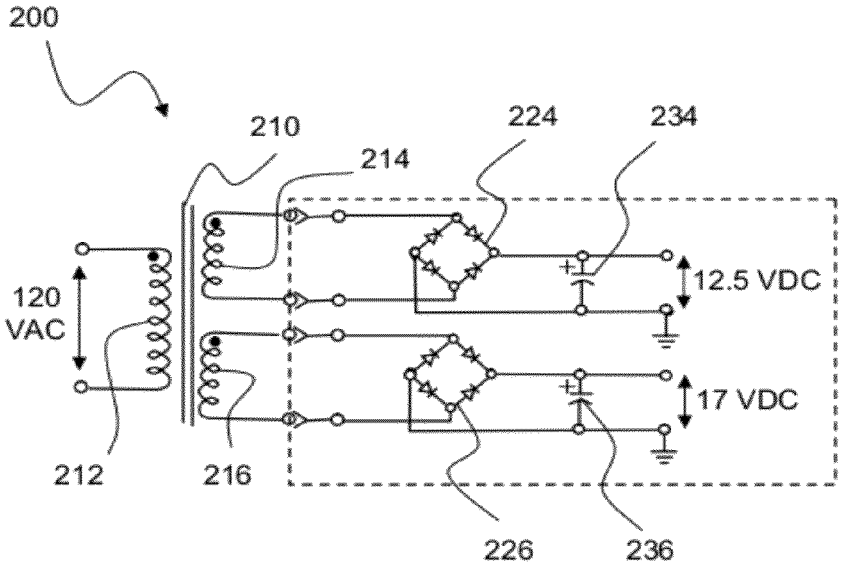
FIG. 2. is a schematic diagram of a power supply usable with the igniter circuit of FIG. 1.

With reference now to FIG. 2 there is illustrated a schematic diagram 200 of a power supply usable with the igniter circuit of FIG. 1. As illustrated in FIG. 2, a single transformer, generally 210, may be provided with a primary winding 212 that is configured to be supplied with about 120 VAC and a pair of secondary windings 214, 216. Secondary windings 214 and 216 are coupled respectively to full wave rectifiers 224, 226 which are coupled to filter capacitors 234, 236, respectively, to produce a relative low output voltage of about 12.5 VDC and a relative high output voltage of about 17 VDC as illustrated. The single transformer 210 is suitably sized to handle the wattage demands of all the burners used on the cooktop.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooktop, comprising:

a gas burner;

a hot surface igniter positioned proximate said gas burner;

a gas flow controlling valve having a manually operable gas flow controlling stem; and a microswitch configured for concurrent operation with said gas flow controlling stem, wherein said microswitch comprises:

a rotatable cam having an outer perimeter surface that includes a plurality of perimeter portions, the plurality of perimeter portions collectively having at least two different radial distances from a central pivoting point of the cam;

a first stationary reed element positioned adjacent to a first side of the cam;

a second stationary reed element positioned adjacent to a second side of the cam; and a pair of pivotable reed elements respectively positioned between the cam and the first and second stationary reed elements, the pair of pivotable reed elements being secured at an angle with respect to each other;

wherein the pair of pivotable reed elements are pivotable between a first position and a second position, the first position providing electrical connection between the first stationary reed element and a first pivotable reed element of the pair of pivotable reed elements, and the second position providing electrical connection between the second stationary reed element and a second pivotable reed element of the pair of pivotable reed elements;

wherein electrical connection between the first stationary reed element and the first pivotable reed element results in a first voltage being provided to the hot surface igniter;

wherein electrical connection between the second stationary reed element and the second pivotable reed element results in a second voltage being provided to the hot surface igniter, the second voltage being lower than the first voltage; and wherein rotation of the cam causes one or more of the plurality of perimeter portions to respectively contact the pair of pivotable reed elements such that the pair of pivotable reed elements sequentially pivot between the first position and the second position.

2. A cooktop, comprising:

a gas burner;

a hot surface igniter positioned proximate said gas burner;

a gas flow controlling valve having a manually operable gas flow controlling stem; and a microswitch configured for concurrent operation with said gas flow controlling stem, wherein said microswitch comprises:

a first pair of reed elements;

a second pair of reed elements positioned at an offset angle with respect to said first pair of reed elements; and a rotatable cam having a central pivoting point and plural outer perimeter portions, said plural outer perimeter portions being diversely spaced from said central pivoting point, wherein one of the reed elements from each of the first and second pair of reed elements are electrically coupled together to form a common connection, and wherein rotation of said cam causes the other of the reed elements from the first pair of reed elements to be electrically coupled to the commonly connected reed elements for a portion of the rotation of the cam, and wherein further rotation of said cam causes the other of the reed elements from the second pair of reed elements to be electrically coupled to the common connected reed elements for a further portion of the rotation of said cam.

3. The cooktop of claim 2, wherein said cam is provided with a keyed opening encompassing said central pivoting point and configured to be positioned over said gas flow controlling stem.

4. The cooktop of claim 3, wherein the keyed opening is D-shaped.

5. The cooktop of claim 2, wherein said plural outer perimeter portions are configured such that rotation of said cam from an initial position for a first predetermined number of degrees of rotation produces no contact between either of said first or second pair of reed elements, wherein rotation following said first predetermined number of degrees of rotation produces contact between said first pair of reed elements for a second predetermined number of degrees of rotation, and wherein rotation following said second predetermined number of degrees of rotation produces contact between said second pair of reed elements while discontinuing contact between said first pair of reed elements.

6. The cooktop of claim 5, wherein the first predetermined number of degrees is about thirty degrees, and wherein the second predetermined number of degrees of rotation is about seventy degrees.

7. A hot surface igniter microswitch, comprising:

a first pair of reed elements;

a second pair of reed elements positioned at an offset angle with respect to said first pair of reed elements; and a rotatable cam having a central pivoting point and plural outer perimeter portions, said plural outer perimeter portions being diversely spaced from said central pivoting point, wherein one of the reed elements from each of the first and second pair of reed elements are electrically coupled together to form a common connection, and wherein rotation of said cam causes the other of the reed elements from the first pair of reed elements to be electrically coupled to the commonly connected reed elements for a portion of the rotation of the cam, and wherein further rotation of said cam causes the other of the reed elements from the second pair of reed elements to be electrically coupled to the common connected reed elements for a further portion of the rotation of said cam.

8. The microswitch of claim 7, wherein said plural outer perimeter portions are configured such that rotation of said cam from an initial position for a first predetermined number of degrees of rotation produces no contact between either of said first or second pair of reed elements, wherein rotation following said first predetermined number of degrees of rotation produces contact between said first pair of reed elements for a second predetermined number of degrees of rotation, and wherein rotation following said second predetermined number of degrees of rotation produces contact between said second pair of reed elements while discontinuing contact between said first pair of reed elements.

9. The microswitch of claim 8, wherein the first predetermined number of degrees is about thirty degrees, and wherein the second predetermined number of degrees of rotation is about seventy degrees.

10. The microswitch of claim 7, further comprising:

a housing configured to contain said first and second pairs of reed elements and said cam, and a connection point coupled to said commonly connected reed elements, wherein said connection point and one of the reed elements of each of the first and second pair of reed elements extends outside said housing.

11. The microswitch of claim 7, wherein said cam is provided with a D-shaped keyed opening encompassing said central pivoting point.

12. A microswitch for use with a hot surface igniter of a cooktop, the microswitch comprising:

a rotatable cam having an outer perimeter surface that includes a plurality of perimeter portions, the plurality of perimeter portions collectively having at least two different radial distances from a central pivoting point of the cam;

a first stationary reed element positioned adjacent to a first side of the cam;

a second stationary reed element positioned adjacent to a second side of the cam; and a pair of pivotable reed elements respectively positioned between the cam and the first and second stationary reed elements, the pair of pivotable reed elements being secured at an angle with respect to each other;

wherein the pair of pivotable reed elements are pivotable between a first position and a second position, the first position providing electrical connection between the first stationary reed element and a first pivotable reed element of the pair of pivotable reed elements, and the second position providing electrical connection between the second stationary reed element and a second pivotable reed element of the pair of pivotable reed elements;

wherein electrical connection between the first stationary reed element and the first pivotable reed element results in a first voltage being provided to the hot surface igniter;

wherein electrical connection between the second stationary reed element and the second pivotable reed element results in a second voltage being provided to the hot surface igniter, the second voltage being lower than the first voltage; and wherein rotation of the cam causes one or more of the plurality of perimeter portions to respectively contact the pair of pivotable reed elements such that the pair of pivotable reed elements sequentially pivot between the first position and the second position.

13. The microswitch of claim 12, wherein the cam is configured for concurrent rotation with a stem of a gas controlling valve of the cooktop.

14. The microswitch of claim 13, wherein the cam includes a central opening through which the stem passes.

15. The microswitch of claim 12, wherein the plurality of perimeter portions are configured such that rotation of the earn from an initial position for a first predetermined number of degrees of rotation produces no contact between the pair of pivotable reed elements and either the first or second stationary reed elements, wherein rotation following said first predetermined number of degrees of rotation places the pair of pivotable reed elements into the first position for a second predetermined number of degrees of rotation, and wherein rotation following said second predetermined number of degrees of rotation places the pair of pivotable reed elements into the second position.

16. The microswitch of claim 15, wherein the first predetermined number of degrees comprises about thirty degrees and the second predetermined number of degrees comprises about seventy degrees.

17. The microswitch of claim 12, wherein:

the pair of pivotable reed elements are electrically connected together; and the pair of pivotable reed elements are configured to be electrically connected to the hot surface igniter.

18. The microswitch of claim 17, wherein:

the first stationary reed element is electrically connected to a first voltage source providing the first voltage; and the second stationary reed element is electrically connected to a second voltage source providing the second voltage.

19. The microswitch of claim 12, wherein the angle at which the pair of pivotable reed elements are secured with respect to each other comprises an obtuse angle.

20. The microswitch of claim 12, wherein:

electrical connection between the first stationary reed element and the first pivotable reed element causes closure of a first relay, the first relay being positioned between the hot surface igniter and a first voltage source providing the first voltage; and electrical connection between the second stationary reed element and the second pivotable reed element causes closure of a second relay, the second relay being positioned between the hot surface igniter and a second voltage source providing the second voltage.

* * * * *

UNITED STATES PATENT AND TRADEMARK OFFICE

CERTIFICATE OF CORRECTION

PATENT NO. : 8,878,104 B2
APPLICATION NO. : 12/951314
DATED : November 4, 2014
INVENTOR(S) : Timothy Scott Shaffer and Daniel Vincent Brosnan It is certified that error appears in the above-identified patent and that said Letters Patent is hereby corrected as shown below:

In the claims

Column 10 Line 21 "…earn from an initial position…" should read --…cam from an initial position…--

Signed and Sealed this
Twentieth Day of September, 2016

Michelle K. Lee

Michelle K. Lee
*Director of the United States Patent and Trademark Office*